US005381168A

United States Patent [19]

Kondo et al.

[11] Patent Number: 5,381,168

[45] Date of Patent: Jan. 10, 1995

[54] SUCTION-PURGING UNIT AND SUCTION PURGING METHOD FOR AN INK JET PRINTER

[75] Inventors: Norimasa Kondo; Takao Matsuoka; Masayuki Ainoya; Takuji Torii; Kazunobu Hayashi; Shuichi Morio; Shinya Tomita, all of Katsuta, Japan

[73] Assignee: Hitachi Koki Co., Ltd., Tokyo, Japan

[21] Appl. No.: 43,842

[22] Filed: Apr. 7, 1993

[30] Foreign Application Priority Data

Apr. 30, 1992 [JP] Japan ..... 4-111149

[51] Int. Cl.[6] ..... B41J 2/165

[52] U.S. Cl. ..... 347/30

[58] Field of Search ..... 346/1.1, 140 R; B41J 2/165; 347/29, 30, 32

[56] References Cited

U.S. PATENT DOCUMENTS 4,577,203 3/1986 Kawamura ..... 346/140 R 5,128,690 7/1992 Nozawa ..... 346/1.1

5,184,147 2/1993 MacLane et al. ..... 346/1.1

5,260,724 11/1993 Tomii et al. ..... 346/140 R

*Primary Examiner*—Benjamin R. Fuller

*Assistant Examiner*—Alrick Bobb

*Attorney, Agent, or Firm*—Sughrue, Mion, Zinn, Macpeak & Seas

[57] ABSTRACT

A suction purging unit for removing dusts solidified ink etc. from nozzles of a print head of an ink jet printer, the nozzles being arrayed in a moving direction of the print head. A contact portion is provided at one side of a body portion in which a fluid passage is formed. The contact portion is contactable with at least one of the nozzles for suction purging, and is separated from the nozzle between-suction purging mode. The body portion is pivotally movable toward and away from the print head, and is vertically movable. The body portion is movable along a top surface of the print head when the latter is moved in the moving direction.

20 Claims, 8 Drawing Sheets

SUCTION-PURGING UNIT AND SUCTION PURGING METHOD FOR AN INK JET PRINTER

BACKGROUND OF THE INVENTION

1. Field of the Invention

The present invention relates to a suction-purging unit and a suction-purging method for use in an ink jet printer.

2. Description of the Related Art

The quiet operation and compact size of ink jet printers has propelled them into popular use in offices for printing desired characters and graphics onto print media upon ink ejection.

However there has been known a problem with conventional ink jet printers in that contaminants such as dirt and paper particles clinging to the head surface, or bubbles generated in the ink pathway, cause inaccurate discharge of ink from the nozzles in the head. Nozzles also can become clogged by ink that has solidified therein, ink films that have adhered to the walls thereof, or contamination within the ink.

Three general measures which have been applied to relieve the above problems are listed below.

1. Pressure purging wherein air bubbles within the nozzle and contamination adhering to the nozzle tips are discharged along with ink by pressurizing or compressing air applied to a rear portion of an ink tank.
2. Suction-purging (such as described in Japanese Patent Application Kokai No. Sho-58-177370) in which a capping suction unit device is mounted to the head so as to cover all the nozzles formed therein, whereupon air bubbles within the nozzle and contamination adhering to the nozzle tips are sucked therefrom by decompression.
3. Pressure/suction-purging wherein a combination of the first two methods is applied.

Although advantageous because of their relatively simple structure, pressure purging units have a known problem in that they discharge ink from all nozzles during purging operations, thereby wasting a great deal of ink. Also, unless all nozzles are uniformly wet at their interiors, effectiveness of purging will be disparate between nozzles.

There has been known a problem with capping suction-purging units in that the larger the head, or the more nozzles are formed therein, the more difficult producing a proper seal between the capping suction device and the head becomes. To produce a proper seal requires increasing the complexity of the capping suction device, the power of the pump, or both.

An additional problem occurs in ink jet printers which use hot-melt ink in that the hot-melt ink hardens during suction-purging. Conventional suction-purging units are not appropriate for use with hot-melt ink, that is, if the power of the suction pump is too low, suction is insufficient, and if too high, ink is sucked within the pump which later causes insufficient suction when the ink hardens.

Also certain components of hot-melt ink evaporate after the hot-melt ink is heated for long periods at a temperature above its melting point. When the hot-melt ink cools, these evaporated components crystallize to the walls of the ink chamber as ink snow. In conventional suction-purging devices, these evaporated components are sucked into the pump where they later harden and lower the suction power of the pump.

SUMMARY OF THE INVENTION

It is therefore, an object of the present invention to overcome the above-described drawbacks, and to provide an improved suction purging unit having a simple arrangement while providing high efficiency without waste of an ink.

Another object of the invention is to provide the suction purging unit available for an ink jet printer using a hot melt type ink.

Still another object of the invention is to provide such suction purging method capable of sufficiently performing the suction purging with respect to nozzles or selected nozzle(s).

These and other objects of the present invention will be attained by providing a suction purging unit for use in an ink jet printer having a print head movable in a horizontal direction, the print head being formed with a plurality of nozzles arrayed in the horizontal direction, the suction purging unit including a body portion, at least one contact portion, a pump, a first moving means and a second moving means. The body portion is adapted for temporarily accumulating an ink sucked from the nozzle. The body portion is movable toward and away from the print head and is movable in a vertical direction. The at least one contact portion is provided to the body portion and is sealingly communicatable with at least one of the nozzles in accordance with the movement of the body portion. The pump is in communication with the body portion for applying a negative pressure in at least one of the nozzles through the body portion and the contact portion in a suction purging to the nozzle. The first moving means is adapted for moving the body portion to bring the contact portion into contact with the at least one nozzle for the suction purging and to separate the contact portion from the at least one nozzle in a non-suction purging. The second moving means is adapted for vertically moving the body portion to vertically move the contact portion to align the contact portion with at least one of the nozzles of the nozzle array.

In another aspect, according to the present invention, there is provided a method for suction-purging nozzles of an ink jet printer, while using a suction purging unit described above. The method includes the steps of closing an ink discharge port of the body portion, contacting the contact portion with the at least one nozzle, energizing the pump for suction purging to the nozzle, deenergizing the pump for stopping the suction-purging to the nozzle, separating the contact portion from the nozzle after a predetermined period is elapsed from the deenergization, and opening the ink discharge port for discharging the an ink from the body portion, the ink having been sucked in the body portion during the suction purging.

BRIEF DESCRIPTION OF THE DRAWINGS

The above and other objects, features and advantages of the invention will become more apparent from reading the following description of the preferred embodiment taken in connection with the accompanying drawings in which:

FIG. 1(*b*) is a perspective view schematically showing a suction-purge unit according to the embodiment of the present invention;

DETAILED DESCRIPTION OF THE PREFERRED EMBODIMENTS

A suction-purge unit according to a preferred embodiment of the present invention will be described while referring to the accompanying drawings.

Figures 1A, 1B:
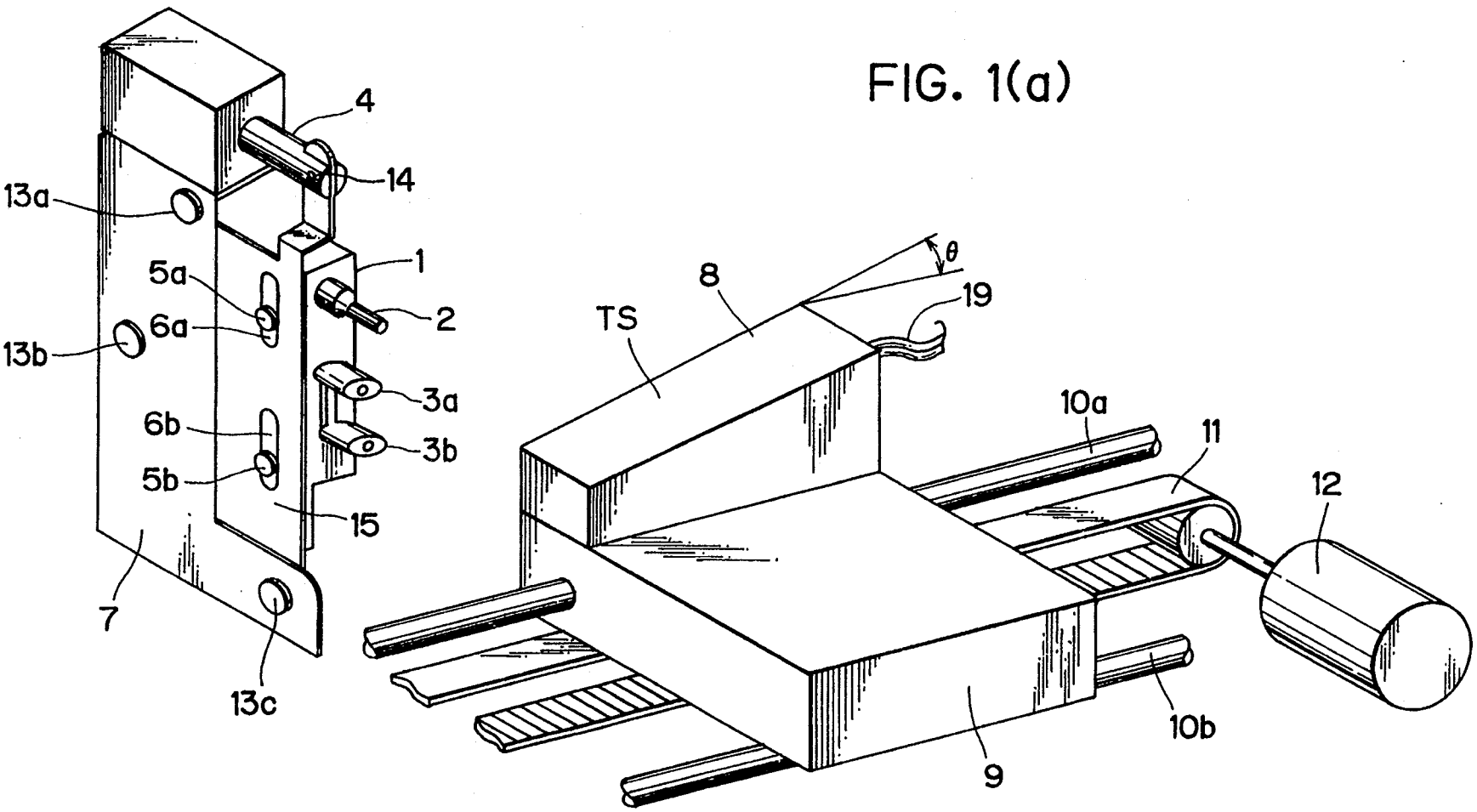
FIG. 1(*a*) is a perspective view showing the head portion of an ink jet printer against which a suction purge unit according to one embodiment of the present invention is used.

As shown in FIG. 1*a*, a loop belt 11 is mounted to, and rotationally driven by, a carriage motor 12. Substantially parallel to and flanking the belt 11 are provided a first shaft 10 and a second shaft 10*b*. Hereinafter the axial direction of the shafts will be referred to as the lateral direction. A carriage 9, which is a parellelpiped, is fixedly mounted to the belt 11 and slidably mounted to the shafts 10 so that the carriage 9 freely moves in the lateral direction (laterally) with movements of the loop belt 11. A head 8 is fixed to the carriage 9 at the side opposing that to which the belt 11 is fixed.

The direction perpendicular to the lateral direction and followed when progressing from the loop belt 11, to the carriage, to the head 8 will hereinafter be referred to as the upward direction. The opposite direction of the upward direction will hereinafter be referred to as the downward direction. The upward direction and the downward direction together will be referred to hereinafter as the vertical direction.

Figure 5:
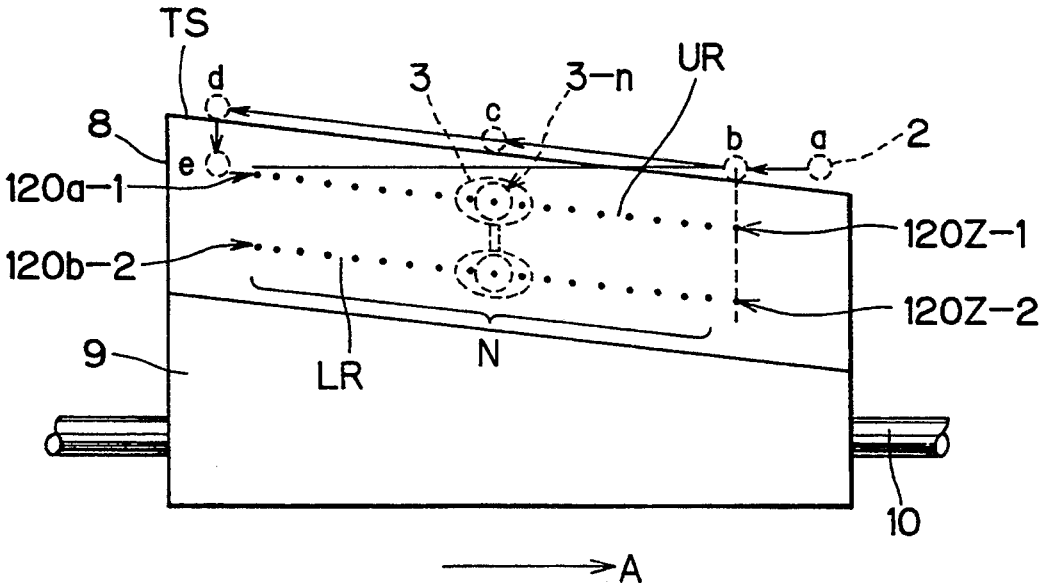
FIG. 5 is a schematic view showing the positional relationship of a guide pin and a suction hole of rubber contacts of the suction-purge unit to the head during the suction-purge mode.

The head 8 is generally a parellelpiped except that its top surface TS, i.e. the surface of the head 8 opposing that to which the carriage 9 is fixed, is provided at an angle $\theta$ relative to the first and second shafts 10*a* and 10*b*. When the ink used is a hot-melt type ink, a head heater 19 is provided to the head 8. As shown in FIG. 5, nozzles N are formed in the head 8 in two generally parallel rows, a lower row of nozzles LR and an upper row of nozzles UR, which are in turn generally parallel to the top surface TS of the head 8. The upper row of nozzles UR is in the upward direction from the lower row of nozzles LR. End nozzles 120*z*-1 and 120*z*-2 are formed at one lateral end of, and opposing nozzles 120*a*-1 and 120*a*-2 formed at the other lateral end of, the rows of nozzles UR and LR respectively.

Figure 2:
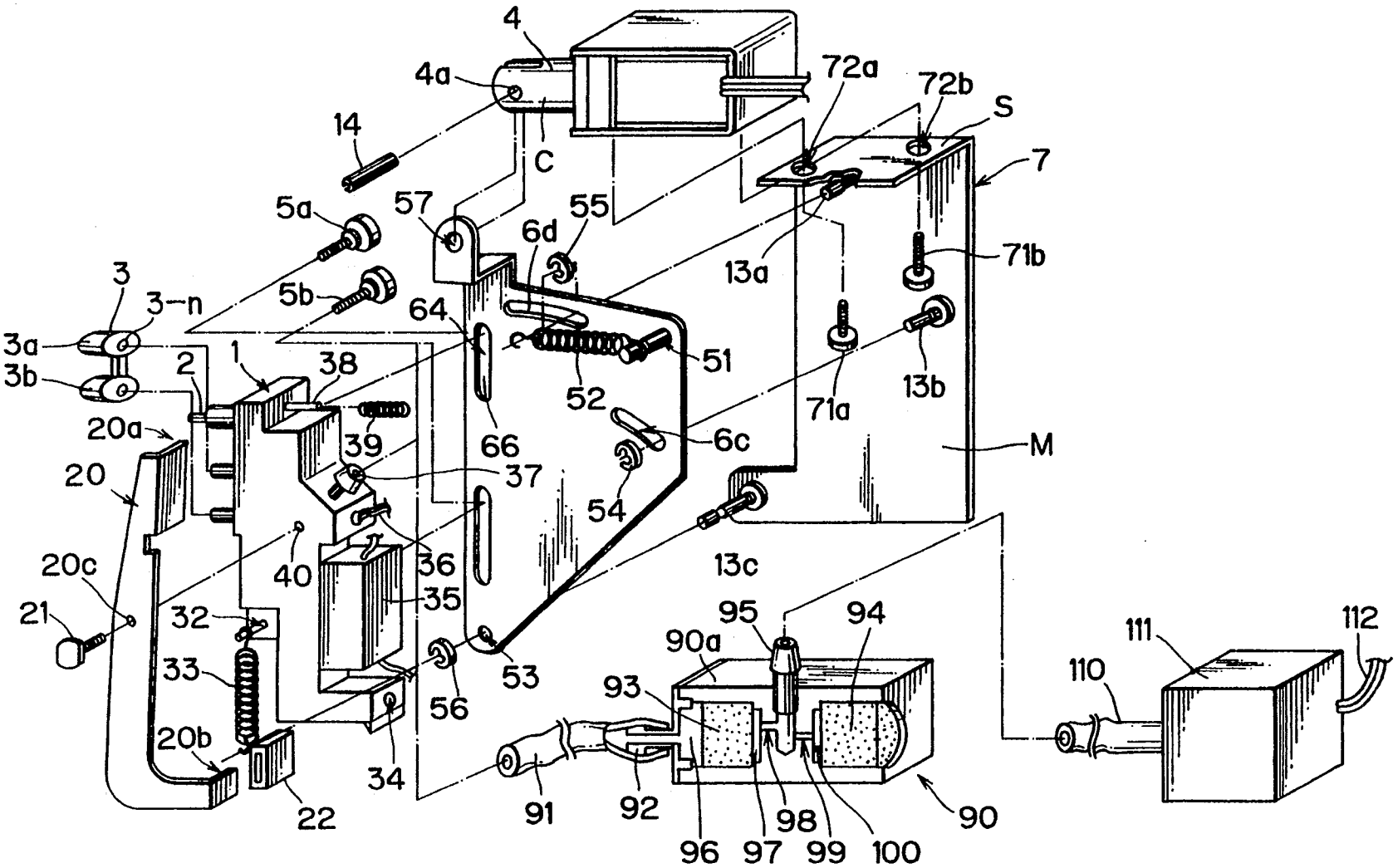
FIG. 2 is an exploded view showing construction of the suction-purge unit of FIG. 1(*b*) in greater detail than, and from a view corresponding to the reverse side shown, in FIG. 1(*b*)

The suction-purge device confronts the nozzles N as shown in FIG. 1*b* at a position within the slidable range of the carriage 9. As can be seen in FIG. 2, the suction-purge unit includes in lateral sequence a drain lever 20, a body 1, an arm plate 15, and an outer frame 7. The suction-purge unit also includes a two-position solenoid 4 with an internal permanent magnet (not shown) and a protruding core C.

The outer frame 7, formed from an integral plate-shaped main section M and a laterally protruding shelf section S, is immovable, for example, by being fixed to a housing (not shown). A narrow edge of the main section M confronts the head 8. In main section M of the outer frame 7 are formed three pins: a first pin 13*a*, a second pin 13*b*, and pivot pin 13*c*. The shelf section S, into which two screw holes, 72*a* and 72*b*, are formed, laterally protrudes from the main section in the upward direction relative to the arm plate 15 and the body 1.

The solenoid 4 is mounted to the shelf section S by screws 71*a* and 71*b* which pass through the screw holes 72*a* and 72*b*. The solenoid 4 has two positions: an IN position, when the core C is IN, and an OUT position, when the core C protrudes OUT. In the core C of the solenoid 4 is formed a hole 4*a* through which passes a pin 14 for connecting, in a manner to be described later, the core C to the arm plate 15. When the core C is OUT, the suction-purge unit is in a suction-purge mode. When the core C is IN, the suction-purge unit is in a between suction-purges mode.

Near the edge of the arm plate 15 confronting the solenoid 4 is formed a protruding member to which is formed a pin hole 57. The pin 14 passes through the pin hole 57 for attaching the core C to the arm plate 15. Either the pin hole 57 has a diameter greater than that of the pin 14, or a downwardly extending slit shape.

Near the edge of the arm plate 15 opposing the edge wherein the pin hole 57 is formed, at a position corresponding to the position of the pivot pin 13*c*, is formed a pivot hole 53. A first and second arcuate pin slits 6*d* and 6*c* are formed in the arm plate 15 at positions, and with arcuate shapes, described by the first pin 13*a* and the second pin 13*b* respectively when the arm plate 15 angularly pivots at the pivot hole 53. The pin 13*c* passes through the pivot hole 53, the first pin 13*a* through the first pin slit 6*d*, and the second pin 13*b* through the second pin slit 6*c*, so that the arm plate 15 is swingably mounted to the outer frame 7. The shapes of the first pin slit 6*d* and the second pin slit 6*c* allow the arm plate 15 to swing on the pivot pin 13*c* within a predetermined range. Clasps 56, 55 and 54 prevent the pivot pin 13*c*, the first pin 13*a*, and the second pin 13*b* respectively from pulling out of the pivot hole 53, the first pin slit 6*d*, and the second pin slit 6*c* respectively.

A pin 51 protrudes from the arm plate 15 near the edge thereof opposing the edge to which the first pin slit 6*d* is formed, and at generally the same vertical level as the first pin slit 6*d*. The pin 51 laterally protrudes away from, and perpendicular to, the main surface M. The pin 51 supports one tip of a tension spring 52. The other end of the tension spring 52 is fixed to the pin 13*a*. The tension spring 52 urges the arm plate 15 to pivot toward the head 8 (counterclockwise direction in FIG. 2).

Two vertically running screw slits 6*a* and 6*b* are formed in the arm plate 15 near an edge confronting the head 8. The body 1 is slidably, generally in the vertical direction, installed to the arm plate 15 at the screw slits 6a and 6b by screws 5a and 5b.

The surface of the body 1 that confronts the nozzles N will hereinafter be referred to as the front surface. In vertical alignment at predetermined positions on the front surface are formed two pipes 31a and 31b and a guide pin 2. The spacing between the pipes 31a and 31b and the guide pin 2 generally corresponds to the spacing between the lower row of nozzles LR, the upper row of nozzles UR, and the top surface TS.

Figure 6:
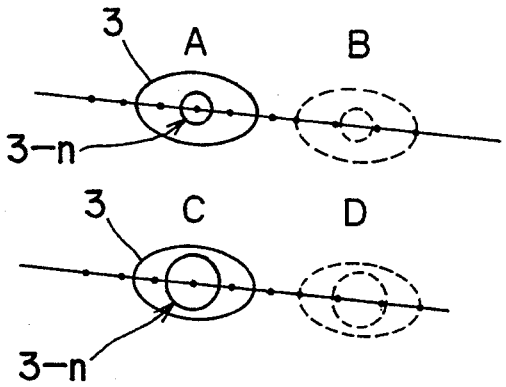
FIG. 6 is a schematic view showing the positional relationship between a suction hole of rubber contacts of the suction-purge unit and the pitch of nozzles in the head.

An upper rubber contact 3a and a lower rubber contact 3b are fitted to the pipes 31a and 31b respectively. The rubber contacts 3a and 3b are made from a heat- and corrosion-resistant, elastic material such as silicone rubber. In the rubber contacts 3a and 3b are formed suction holes 3-n, the diameter of which determines the number of nozzles N suction-purged at any one instant. A and B in FIG. 6 represent situations occurring when suction hole 3-n is slightly smaller than the nozzle pitch. When such a small diameter suction hole 3-n and a nozzle N are concentric, as represented by A, suction-purging can be performed on the one nozzle N. However, when the small diameter suction hole 3-n is between nozzles, as represented by B, no nozzles are suction-purged. Although with a small diameter suction hole 3-n only one nozzle N can be suction-purged at one time, each nozzle N is accurately suction-purged.

Doubling the diameter of the small diameter suction hole 3-n shown in A and B produces a large diameter suction hole 3-n as shown in C and D. By using the large diameter suction hole 3-n, two nozzles N can be suction-purged simultaneously. Even when the large diameter suction hole 3-n is centered in between two nozzles N, as shown in D, the suction hole 3-n is large enough to suction-purge both nozzles N simultaneously, thus increasing efficiency. Although not shown in FIG. 6, by further enlarging the diameter of the suction hole 3-n, more nozzles N can be suction-purged simultaneously. The number of nozzles N simultaneously suction-purged can be easily designated by adjusting the size of the suction hole 3-n. The suction-purge system can be easily designed by fixing either the size of the suction hole 3-n according to the power of a suction pump 111 (described later) or vice versa.

The drain lever 20 is generally L-shaped with a vertically protruding section and a horizontally protruding section. The horizontally protruding section protrudes away from the head 8 at a 90° angle to the vertically protruding section. A first plate 20a and a second plate 20c laterally protrude toward the main section M of the outer frame 7 from the tips of the vertically protruding section and the horizontally protruding section respectively. A rubber cover 22 is fitted to the tip of the second plate 20c. A drain lever screw hole 21c is formed in the general center of the drain lever 20.

To the lateral side of the body 1 opposing the side to which the arm plate 15 is attached are formed a body screw hole 40 and a tension spring pin 32. The drain lever 20 is swingably installed to the lateral side of the body 1 via a pivot screw 21 which is inserted through the drain lever screw hole 20c and screwed into the body screw hole 40. One tip of a tension spring 33 is secured to the pin 32. The other tip of the tension spring 33 is secured to the pivot pin 13c of the outer frame 7. Therefore, the extension strength of the tension spring 33 urges the body 1 downward. This downward travel is achievable within a length of the slots 6a, 6b.

The side of the body 1 opposing the front surface will hereinafter be referred to as the back surface. The side of the body 1 attained by progressing in the upward direction along the back surface will hereinafter be referred to as the upper surface. The side of the body 1 opposing the upper surface will hereinafter be referred to as the lower surface.

Next, components provided to the back surface of the body 1 will be described. Near the lower surface is formed a drain hole 34 for discharging suction-purged ink. Near the top surface is provided a protruding compression spring pin 38 which protrudes generally parallel to the vertically protruding section of the drain lever 20. To the compression spring pin 38 is fitted a compression spring 39 which abuts one side of the upper laterally protruding plate 20a of the drain lever 20. The compression strength of the compression spring 39 urges the upper laterally protruding plate 20a away from the body 1 into abutment with the first pin 13a.

At the start of the suction-purge mode the body 1 moves toward the head 8, i.e., away from the first pin 13a. Because the upper laterally protruding plate 20a is urged by the compression spring 39 into abutment with the first pin 13a, the drain lever 20 remains stationary with regard to the outer frame 7. However, because the body 1 pivotally moves toward the head 8 when switching from the between suction purge mode to the suction-purge mode, the drain hole 34 moves toward the rubber cover 22 into sealing contact therewith.

Figure 3:
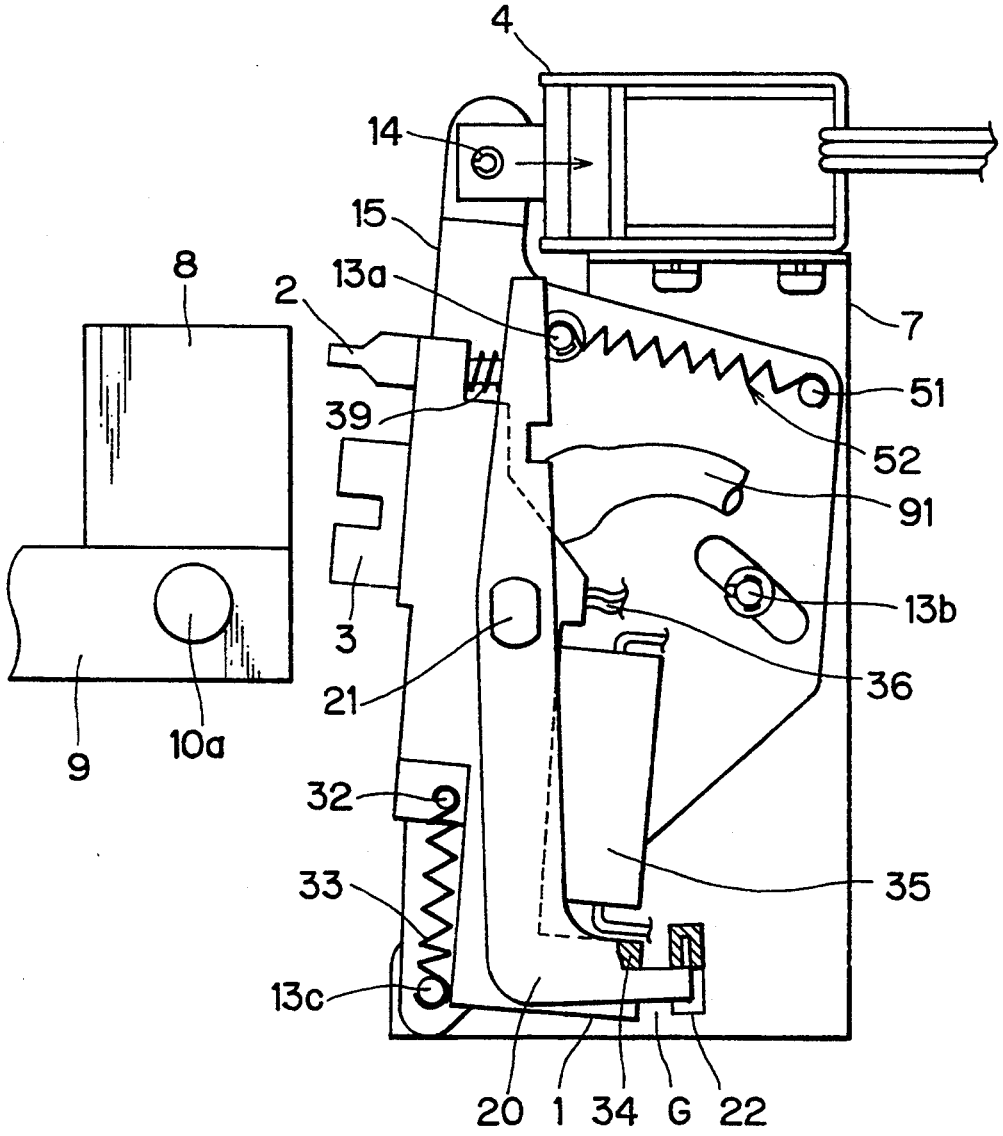
FIG. 3 is a schematic view showing the suction-purge unit during a between suction-purges mode.

The body 1 moves away from the head 8 at the start of the between suction-purges mode, thus reducing the distant between the body 1 and the upper laterally protruding plate 20a which remains in abutment with the first pin 13a at the urging of the compression spring 39. The drain lever 20 pivots in the opposite direction, whereupon a gap G (FIG. 3) forms between the lower laterally protruding plate 20b and the drain hole 34. Gap G is large enough to allow ink to be discharged from the drain hole 34 without interference from the ink's meniscus, that is, usually greater than 3 mm.

In the upward direction from the drain hole 34 is provided a heater 35, a body temperature detection sensor 36, and a suction pipe 37. The temperature in the body 1 is measured by the body temperature detection sensor 36 and the heater 35 is turned ON and OFF accordingly to maintain a temperature slightly higher than the melting point of the ink.

Figure 7:
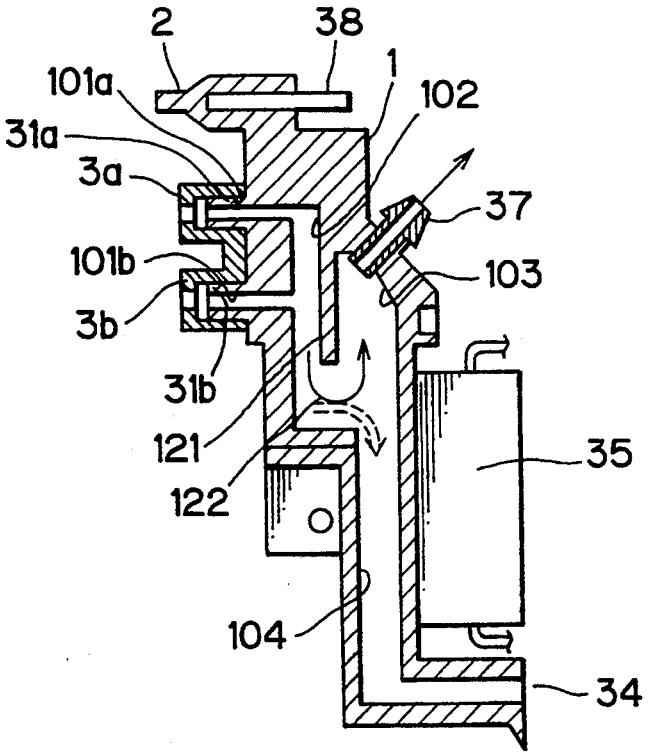
FIG. 7 is a cross-sectional view showing the internal components of a body of the suction-purge unit.

As shown in FIG. 7, the interior of the body 1 has several interconnecting passages and chambers. Within the two pipes 31a and 31b are pipe passages 101a and 101b respectively. These two pipe passages merge into an ink/air mix passage 102, one side of which is formed by a wall 121. On the opposite side of the wall 121 is an air discharge chamber 103, which is connected to the suction pipe 37. The ink/air mix passage 102 and the air discharge chamber 103 are generally at the same vertical level. The ink/air mix passage 102 and the air discharge chamber 103 are connected by an ink/air separation chamber 122 which is at a vertical level lower than that of the ink/air mix passage 102 and the air discharge chamber 103. The ink/air separation chamber 122 has a caliber larger than that of the ink/air mix passage 102. The ink/air separation chamber 122 is connected to the drain hole 34 by an ink discharge passage 104 which is at a lower vertical level than the ink/air separation chamber 122.

A fluid passage is provided between the suction pipe 37 and a suction pump 111, via a tube 91, which is insertedly connected at one end to the suction pipe 37 and to an inlet 92 of a filter unit 90 at the other, and an inlet tube 110, which is insertedly connected to an outlet 95 of the filter unit 90 at one end and the suction pump 111 at the other. The inlet 92 is provided to a filter body 90*a* the filter unit 90. The filter body 90 houses, following the fluid passage from the inlet 92 toward the outlet 95, a first empty chamber 96, a first porous open cell filter 93, a second empty chamber 97, and a restricter 98. The filter body 90*a* also houses a second porous open cell filter 94 which has one end in communication with the atmosphere and the opposing end opening to a third empty chamber 100. The third empty chamber 100 is connected to an air leak valve hole 99 which is in turn connected to the outlet 95. The first empty chamber 96 is larger than the other empty chambers. The suction pump 111 is driven by a drive motor (not shown) connected to the suction pump 111 by a cable 112.

Suction-purge operations of the suction-purge unit according to the preferred embodiment will be described below. At the start of the between suction-purges mode, the solenoid 4 is rendered OFF, so that the core C of the solenoid 4 moves IN, that is, is attracted to the permanent magnet in the solenoid 4 in the direction indicated by the arrow in FIG. 3. The attractive force of the permanent magnet overcomes the sum of the urging forces caused by the tension spring 52 and the compression spring 39. Therefore the arm plate 15 is prevented from following the urging of the spring 52. Consequently, a space separates the rubber contacts 3 and the head 8, and the gap G separates the rubber cover 22 and the drain hole 34.

Figure 4:
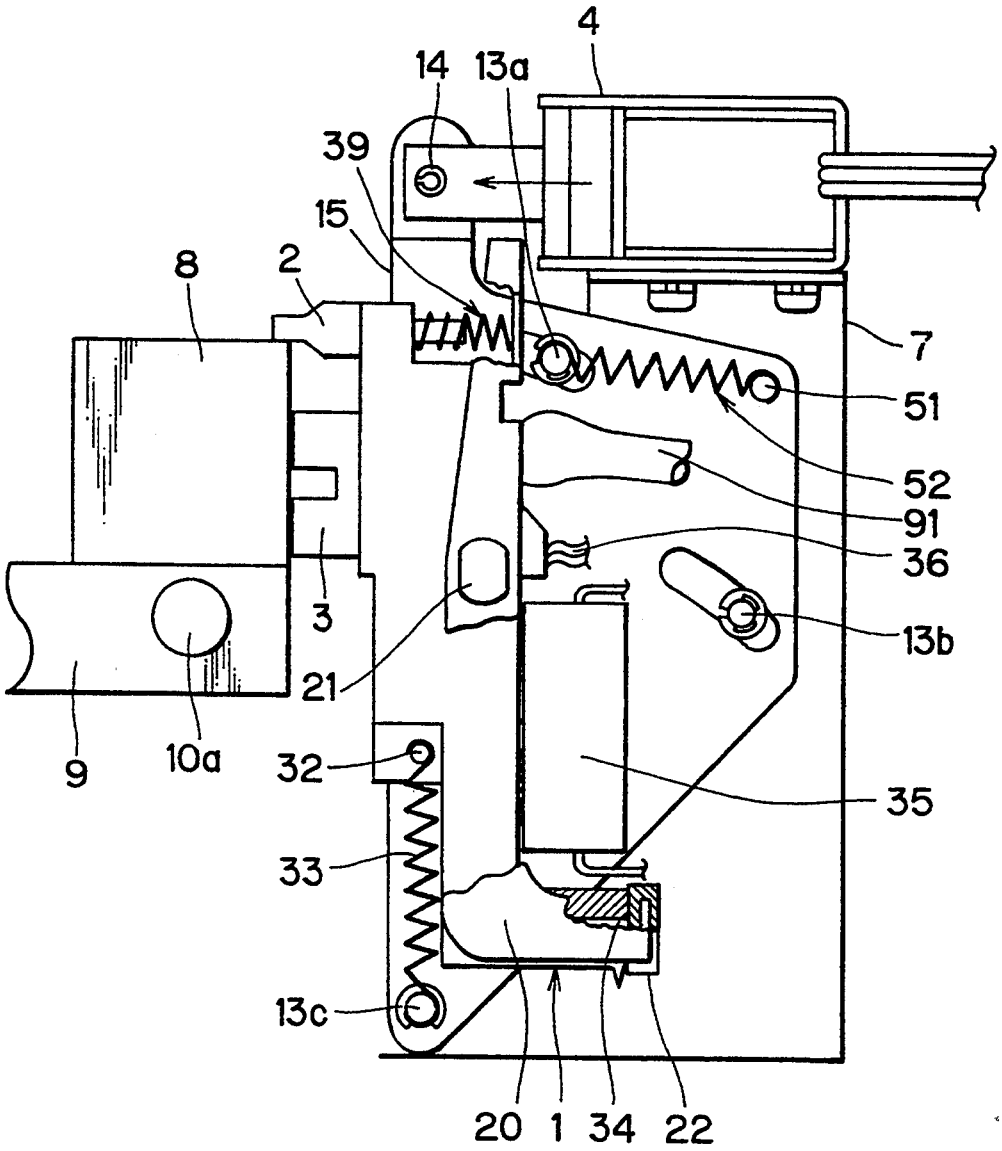
FIG. 4 is a schematic view showing the suction-purge unit during a suction-purge mode.

Energizing the solenoid 4 causes a repulsive force to form therein which is greater than the attractive force of the permanent magnet. The core C moves in the direction indicated by the arrow in FIG. 4 to the OUT position so that the suction-purge unit enters the suction-purge mode. Consequently, the arm plate 15, which is attached to the core C by the pin 14, pivots toward the head 8 about the pivot pin 13*c*. The body 1 moves with the arm plate 15, since the body 1 is vertically movably supported to the arm plate 15 by the screws 5*a*, 5*b* so that the rubber contact 3 abuts the front surface of the head 8. Also, as described above, the rubber cover 22 covers the drain hole 34. It should be noted that at this point the guide pin 2 is on the top surface TS of the head 8.

During purging operations, after the suction-purge unit enters the suction-purging mode, the lateral movements of the carriage 9 steadily laterally moves the head 8 in the direction indicated by an arrow A in FIG. 5. It should be noted that since the guide pin 2 is provided at the body 1, the guide pin 2 moves only vertically. Shortly after the start of the suction-purge mode, the guide pin 2 will be relative to the head 8 at the position marked "a" in the figure. At position "a," the guide pin 2 confronts, but does not contact, the top surface TS. As the carriage 9 proceeds, the guide pin 2 will come into contact with the head 8 at the position marked "b." At position "b," the guide pin 2 is either in linear alignment with the end nozzles 120*z*-1 and 120*z*-2, or at a position not overlapping these rows. As the head 8 laterally progresses beyond position "b," the guide pin 2 is urged upward by the angle D of slanting top surface TS against the biasing force of the tension spring 33. The movement of the head 8 overcomes the downward urging of the tension spring 33 so that the body 1 and the guide pin 2 integratedly move upward.

As the head 8 further progresses, the guide pin 2 will be at positions "c," then "d," and then "e" relative thereto. When the guide pin 2 is at position "c," the suction hole is concentric with a nozzle hole as shown in A and C of FIG. 6. At position "d," the guide pin 2 is at a position near the opposing nozzles 120*a*-1 and 120*a*-2 but not overlapping the rows. At position "e," the top surface TS of the head 8 has passed beyond the guide pin 2 as a result of the pivotal return motion of the body 1, which implies the termination of the suction-purging. Because the guide pin 2 is no longer upwardly urged by the angle $\theta$ of the top surface TS, the body 1 and the guide pin integrally return to the position urged by the tension spring 33. It should be noted that position "e" is actually the same position as "a," but after time has progressed. Position "e" marks completion of the suction-purge operation and the start of the between suction-purges mode, whereupon the body 1 moves downward. Afterward the solenoid 4 is deenergized, whereupon simultaneously the core C is attracted into the solenoid 4 by the permanent magnet, the rubber contacts 3 move away from the head, and the drain cover 20 moves away from the drain hole 34 so that gap G forms therebetween.

It will be recalled that during suction-purging operation mode, the rubber cover 22 forms a leakproof seal with the drain hole 34, and the rubber contacts 3 abut the head 8. Therefore, when air is sucked from the discharge chamber 103 through the suction pipe 37 as shown in FIG. 7, a vacuum caused within the body 1 draws ink from the nozzles, mixed with a small amount of air from a minute space between the rubber contacts 3 and the nozzles N, into the pipe passages 101*a* and 101*b*. The ink/air mix flows into the ink/air mix passage 102 and follows the wall 121 into the ink/air separation chamber 122. The flow of the ink/air mix rapidly slows when the mixture enters the ink/air separation chamber 122 because of the larger caliber thereof and partitioning by the wall 121. The ink separates from the air and flows down into the ink discharge passage 104 while the air is sucked into the air discharge chamber 103 and out the suction pipe 37.

This body 1 for ink purging can be used for purging of liquid ink or hot-melt ink. Further, the body 1 is compact in size to reduce installation space.

Figure 8:
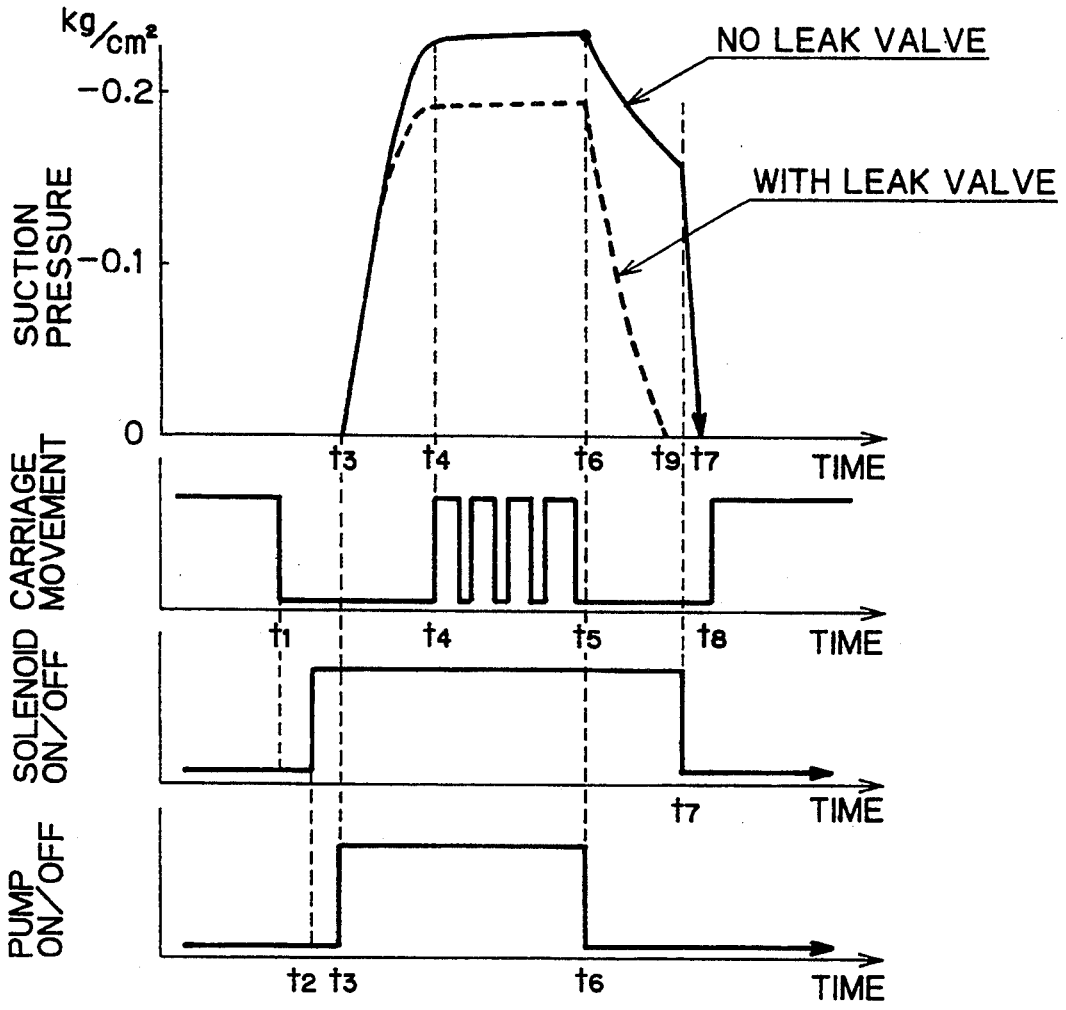
FIG. 8 is a time chart temporally showing the operation of the suction-purge unit.

As per FIG. 8, at time $t_1$ the carriage 9 moves to the position where suction-purge operation will be performed, that is, position "a" in FIG. 5, and temporarily stops. At time $t_2$ the core C of the solenoid 4 moves OUT, causing the rubber contacts 3 to abut the head 8. At time $t_3$ the suction pump 111 begins pumping. A few seconds after time $t_3$, vacuum within the body 1 reaches almost 100% at time $t_4$ whereupon the carriage 9 moves to position "b" indicated in FIG. 5. The suction hole 3-n of the rubber contact 3 reaches end nozzles 120*z*-1 and 120*z*-2 whereupon ink suction-purging begins. The carriage 9 intermittently moves at distances generally equal to the pitch of the nozzles N. The carriage 9 stops for a predetermined time each time the suction holes 3-n become aligned with nozzles N. The carriage 9 moves and stops repeatedly until it reaches position "d" in FIG. 5 at time $t_5$. The pump 111 turns OFF at time $t_6$. After a few seconds, at time $t_7$, the core of the solenoid 4 moves IN, causing the gap G to form between the rubber cover 22 and the drain hole 34, and the ink suction-purged into the body 1 to be discharged from the drain hole 34. Through this succession of operations, all the nozzles N of the head 8 are suction-purged. Thereafter, the head 8 can perform an ordinary printing operation.

If the carriage 9 moves slowly enough during the time period between time $t_4$ and time $t_5$, movements of the carriage 9 can be continuous instead of intermittent. When the movements of the carriage 9 are intermittent, usually suction-purging each nozzle N for one to two seconds is sufficient. When movement of the carriage is continuous, the speed of the carriage is determined by the following equation:

$$(p/st)\times(s/a)$$

where "p" is the nozzle pitch, "st" is the stop time, "s/a" is suction efficiency where "s" is the size of the hole in the rubber contact and "a" is a constant defined by the nozzle pitch.

Figure 10:
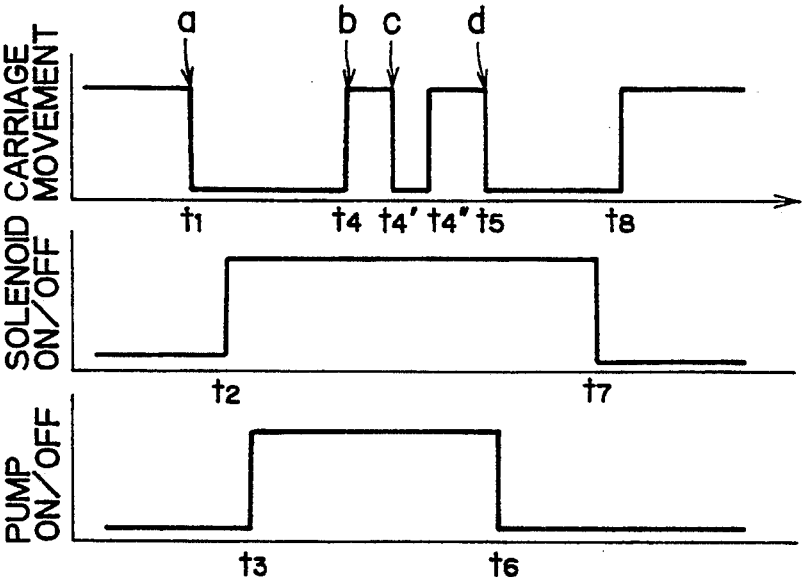
FIG. 10 is time chart showing changes in the positional relationship between the head and the guide pin, the position of a solenoid core in the suction-purge unit, the status of a power source, all with respect to temporal changes.

If discharge of ink by the head 8 becomes defective during printing because a specific nozzle N becomes clogged, the position of the nozzle N is inputted via a control panel (not shown) and the suction-purge operation is performed on the one nozzle N only. As indicated in the carriage move chart in FIG. 10, the carriage 9 rapidly moves from position "b" to position "c" between times $t_4$ and time $t_4'$. The carriage 9 stops at position "c" where suction-purging is sufficiently performed. When performed on only one nozzle in this manner, suction-purging should be performed two to three times as long as during standard suction-purging operations. Afterward, the carriage 9 rapidly moves from position "c" to position "d."

The above method is much quicker than suction-purging all nozzles N at a continuous rate. Also, since only the nozzle N that causes poor printing is suction-purged, less ink is discharged and wasted.

When suction-purge is performed without a filter unit 90 attached, pressure inside the body 1 changes as indicated by the curve labeled NO LEAK VALVE in FIG. 8. When the suction pump 111 is turned OFF at time $t_6$, leaks in the suction pump 111 and minute gaps between the rubber contact 3 and the head 8 cause pressure to slowly start dropping. When the core C moves IN and the drain hole 34 and the suction hole 3-n of the rubber contact 3 are opened to the atmosphere at time $t_7$, causing a sudden flow of air through the body 1 as air moves to fill the remaining internal vacuum. Ink sometimes flows with this air flow in the form of ink mist into the tube 91 even as far as to the pump 111, causing a drop in suction pressure or damage to the pump 111.

Attaching a filter unit 90, however, although the leak valve 99 thereof causes a certain decrease in suction power of the pump 111, causes vacuum within the suction-purge unit to restore atmospheric pressure, that is, between time $t_6$ and time $t_9$ as indicated by the curve in FIG. 8 labeled WITH LEAK VALVE. Under the condition, vacuum in the suction-purge unit returns to atmospheric pressure within three seconds after the suction pump 111 is turned OFF, thus preventing the above problems.

Figure 9:
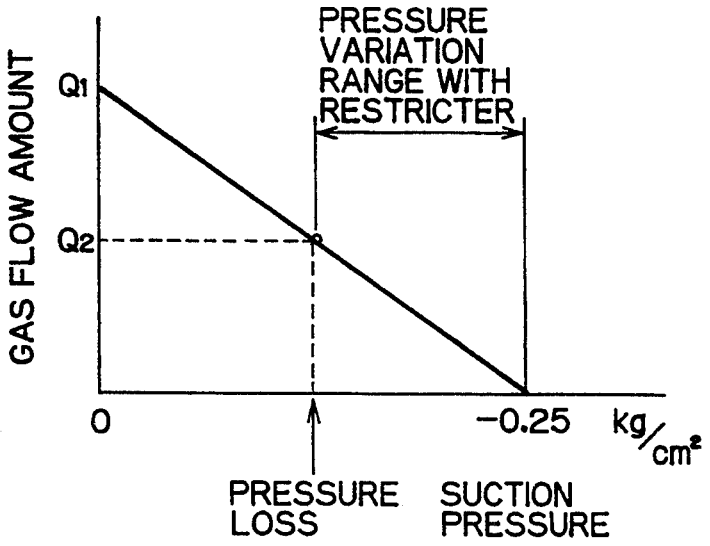
FIG. 9 is a graphical representation of effects of a restricter in the suction-purge unit on air flow.

When the seal between the rubber cover 22 and the drain hole 34, the seal between the rubber contacts 3 and the head 8, or both seals deteriorate, causing leaks during suction-purge operations, the air flow speed in the tubing needs to be lowered. As shown in FIG. 9, reducing a diameter of the fluid passage by the restricter 99 in the filter unit suppresses a maximum reverse flow of air $Q_1$ to a reverse flow of air $Q_2$, even when the rubber contact 3, the suction hole 3-n, and the drain hole 34 are completely open. Table 1 below shows the restricter method used in the preferred embodiment. The restricter 99 should have a diameter larger than that of the leak valve 98.

| | Generated pressure and pressure loss ($kg/cm^2$) | Hole diameter (mm) |
|---|---|---|
| Pump pressure | −0.25 | — |
| Restricter | 0.13 | 0.5 × 4 |
| Leak hole | 0.21 | 0.3 × 4 |

The inventer found gaseous components from which ink snow is formed are also generated in the ink chamber of the present invention. The larger area of the air chamber 96 is for slowing the flow air from the tube 91 to intentionally crystalize the gaseous components to the walls of the air chamber 96, forming ink snow therein. The thus-formed ink snow does not enter the filter 93 of the filter unit, thus preventing clogging of the filter 93. Accordingly, the restricter 98 and the pump 111 are also protected against the ink snow.

The suction-purge unit according to the present invention has simple arrangement with high suction performance by the drive solenoid, the coil springs and the arm plate, etc., in association with the body where the movements of each component is in accordance with the solenoid.

Further, in the present invention, selective purging is attainable with respect to at least one nozzle. Therefore, ink discharge amount can be reduced, and high reliability in purging results. Furthermore, a specific one of the nozzles can undergo purging where clogging occurs.

In another aspect, since the restricter is provided at a position upstream of the suction pump, the latter can be sufficiently protected against the ink or ink snow. Moreover, the empty chambers and the filter are provided upstream of the restricter, the restricter and the pump can be protected from the ink snow.

While the invention has been described in detail with reference to specific embodiments thereof, it would be apparent to those skilled in the art that various changes and modifications may be made therein without departing from the spirit and scope of the invention.

What is claimed is:

1. A suction purging unit for use in an ink jet printer having a print head movable in a horizontal direction, the print head having a top surface which is slanted by a minor angle relative to the horizontal direction, and being formed with a plurality of nozzles arrayed parallel to the top surface, the suction purging unit comprising:

a body portion for temporarily accumulating an ink sucked from at least one of the nozzles, the body portion being movable toward and away from the print head and being movable in a vertical direction;

at least one contact portion provided on the body portion and operative to sealingly communicate with at least one of the nozzles in accordance with the movement of the body portion;

a pump in communication with the body portion for applying a negative pressure in at least one of the nozzles through the body portion and the at least one contact portion during a suction purging of the at least one of the nozzles;

first moving means for moving the body portion to bring the at least one contact portion into contact with the at least one of the nozzles for the suction purging and to separate the at least one contact portion from the at least one of the nozzles in a non-suction purging mode; and second moving means for vertically moving the body portion thereby vertically moving the at least one contact portion to align the at least one contact portion with at least one of the nozzles plural of the second moving means comprising a pin member extending from the body portion toward the print head, the pin member being slidable on the top surface of the print head, and means for normally urging the body portion downwardly for maintaining surface contact of the pin with the top surface of the print head during passage of the print head relative to the pin.

2. The suction purging unit as claimed in claim 1, further comprising an outer frame, an arm plate having one end portion pivotally supported to the outer frame and an other end portion, the body portion being vertically movably supported to the arm plate.

3. The suction purging unit as claimed in claim 2, wherein the first moving means comprises:

a solenoid fixed to the outer frame and connected to the other end of the arm plate for pivotally and selectively moving the arm plate away from the print head:

a first tension spring secured between the outer frame and the arm plate for pivotally moving the arm plate toward the print head, the solenoid having a retraction force greater than a biasing force of the first tension spring.

4. A suction purging unit for use in an ink jet printer having a print head movable in a horizontal direction, the print head being formed with a plurality of nozzles arrayed in the horizontal direction, the suction purging unit comprising:

a body portion for temporarily accumulating an ink sucked from at least one of the nozzles, the body portion being movable toward and away from the print head and being movable in a vertical direction;

at least one contact portion provided on the body portion and operative to sealingly communicate with at least one of the nozzles in accordance with the movement of the body portion;

a pump in communication with the body portion for applying a negative pressure in at least one of the nozzles through the body portion and the at least one contact portion during a suction purging of the at least one of the nozzles;

first moving means for moving the body portion to bring the at least one contact portion into contact with the at least one of the nozzles for the suction purging and to separate the at least one contact portion from the at least one of the nozzles in a nonsuction purging mode;

second moving means for vertically moving the body portion thereby vertically moving the at least one contact portion to align the at least one contact portion with at least one of the nozzles of the nozzle array; and an outer frame, an arm plate having one end portion pivotally supported to the outer frame and an other end portion, the body portion being vertically movably supported to the arm plate, wherein the first moving means comprises:

a solenoid fixed to the outer frame and connected to the other end of the arm plate for pivotally and selectively moving the arm plate away from the print head;

a first tension spring secured between the outer frame and the arm plate for pivotally moving the arm plate toward the print head, the solenoid having a retraction force greater than a biasing force of the first tension spring, wherein the outer frame has a pivot pin extending in the horizontal direction, the pin serving as a pivot shaft for a pivotal motion of the arm plate.

5. The suction purging unit as claimed in claim 4, wherein the arm plate is formed with at least one slot extending in the vertical direction, and the unit further comprising at least one screw extending through the at least one slot for vertically movably supporting the body portion to the arm plate.

6. The suction purging unit as claimed in claim 5, wherein the second moving means comprises;

a pin member extending from the body portion toward the print head, the pin member being slidable on an upper surface of the print head; and a second tension spring having one end connected to the body portion and another end connected to the pivot pin for normally urging the body portion downwardly.

7. The suction purging unit as claimed in claim 6, wherein the body portion defines therein an ink/air mixture passage in communication with the at least one contact portion, an ink/air separation chamber in communication with the ink/air mixture passage, an ink discharge passage having a discharge opening and in communication with the ink/air separation chamber, an air discharge chamber in communication with the ink/air separation chamber and connected to the pump.

8. The suction purging unit as claimed in claim 7, further comprising shut-off means for closing the discharge opening wherein the at least one contact portion is in contact with the at least one of the nozzles and for opening the discharge opening when the at least one contact portion is out of contact from the at least one of the nozzles.

9. The suction purging unit as claimed in claim 8, wherein the shut off means comprises;

a lever member having an intermediate portion pivotally supported to the body portion, the lever member having one end portion provided with a cover member for covering the discharge opening in response to the pivotal movement of the body portion toward the print head, the lever member having another end;

a compression spring interposed between the body portion and the other end of the lever member for urging the lever member to displace the cover member toward the discharge opening; and a stop member extending from the outer frame and abuttable on the other end of the lever member for restricting full pivotal motion thereof to provide open an state of the discharge opening when the body portion is pivoted away from the print head.

10. The suction purging unit as claimed in claim 9 further comprising a heater unit provided on the body portion for heating the sucked ink, and controller for controlling the heater unit.

11. The suction purging unit as claimed in claim 10, wherein the print head has a top flat surface extending slightly obliquely with respect to the horizontal direction, the plurality of nozzles being arrayed in a direction parallel to the top flat surface.

12. The suction purging unit as claimed in claim 1 further comprising a heater unit provided on the body portion for heating the sucked ink, and controller for controlling the heater unit.

13. A suction purging unit for use in an ink jet printer having a print head movable in a horizontal direction, the print head being formed with a plurality of nozzles arrayed in the horizontal direction, the suction purging unit comprising:

a body portion for temporarily accumulating an ink sucked from at least one of the nozzles, the body portion being movable toward and away from the print head and being movable in a vertical direction;

at least one contact portion provided on the body portion and operative to sealingly communicate with at least one of the nozzles in accordance with the movement of the body portion;

a pump in communication with the body portion for applying a negative pressure in at least one of the nozzles through the body portion and the at least one contact portion during a suction purging of the at least one of the nozzles;

first moving means for moving the body portion to bring the at least one contact portion into contact with the at least one of the nozzles for the suction purging and to separate the at least one contact portion from the at least one of the nozzles in a non-suction purging mode; and second moving means for vertically moving the body portion thereby vertically moving the at least one contact portion to align the at least one contact portion with at least one of the nozzles of the nozzle array, wherein the body portion defines therein an ink/air mixture passage in communication with the at least one contact portion, an ink/air separation chamber in communication with the ink/air mixture passage, an ink discharge passage having a discharge opening and in communication with the ink/air separation chamber, an air discharge chamber in communication with the ink/air separation chamber and connected to the pump.

14. The suction purging unit as claimed in claim 13, further comprising a filter unit provided between the air discharge chamber and the pump, the filter unit comprising a body member for housing a first filter, and a restricter disposed in the body member at a position downstream of the first filter with respect to a suction flow direction, the body member being formed with a leak valve hole downstream of the restricter for partially discharging the sucked ink to atmosphere.

15. The suction purging unit as claimed in claim 14, wherein the body member defines therein an empty chamber at a position upstream of the first filter for trapping ink snow in the empty chamber.

16. A suction purging unit for use in an ink jet printer having a print head movable in a horizontal direction, the print head being formed with a plurality of nozzles arrayed in the horizontal direction, the suction purging unit comprising a body portion for temporarily accumulating an ink sucked from at least one of the nozzles, the body portion being movable toward and away from the print head and being movable in a vertical direction;

at least one contact portion provided on the body portion and operative to sealingly communicate with at least one of the nozzles in accordance with the movement of the body portion a pump in communication with the body portion for applying a negative pressure in at least one of the nozzles through the body portion and the at least one contact portion during a suction purging of the at least one of the nozzles;

first moving means for moving the body portion to bring the at least one contact portion into contact with the at least one of the nozzles for the suction purging and to separate the at least one contact portion from the at least one of the nozzles in a nonsuction purging mode; and second moving means for vertically moving the body portion thereby vertically moving the at least one contact portion to align the at least one contact portion with at least one of the nozzles of the nozzle array, wherein the print head has a top flat surface extending slightly obliquely with respect to the horizontal direction, the plurality of nozzles being arrayed in a direction parallel to the top flat surface.

17. A method for suction-purging nozzles of an ink jet printer, using a suction purging unit for purging at least one nozzle of a nozzle array of a print head of the ink jet printer, the suction purging unit comprising a body portion for temporarily accumulating an ink sucked from the at least one of the nozzles and discharging the sucked ink through an ink discharge port, the body portion being movable toward and away from the print head and being movable in a vertical direction; at least one contact portion provided on the body portion and operative to sealingly communicate with the at least one of the nozzles in accordance with the movement of the body portion; a pump in communication with the body portion for applying a negative pressure in the at least one of the nozzles through the body portion and the at least one contact portion in a suction purging of the at least one of the nozzles; first moving means for moving the body portion to bring the at least one contact portion into contact with the at least one of the nozzles for the suction purging and to separate the at least one contact portion from the at least one of the nozzles in a non-suction purging mode; and second moving means for vertically moving the body portion thereby vertically moving the at least one contact portion to align the at least one contact portion with the at least one of the nozzles of the nozzle array, the second moving means comprising a pin member extending from the body portion toward the print head, the pin member being slidable on a top surface of the print head, and means for normally urging the body portion downwardly for maintaining surface contact of the pin with the top surface of the print head during passage of the print head relative to the pin, the method comprising the steps of:

closing the ink discharge port;

contacting the at least one contact portion with the at least one of the nozzles;

energizing the pump for suction purging of the at least one of the nozzles;

deenergizing the pump for stopping the suction-purging of the at least one of the nozzles;

separating the at least one contact portion from the at least one of the nozzles after a predetermined period is elapsed from the deenergization; and opening the ink discharge port for discharging an ink from the body portion, the ink having been sucked in the body portion during the suction purging.

18. A method for suction-purging nozzles of an ink jet printer, using a suction purging unit for purging at least one nozzle of a nozzle array of a print head of the ink jet printer, the suction purging unit comprising a body portion for temporarily accumulating an ink sucked from the at least one of the nozzles and discharging the sucked ink through an ink discharge port, the body portion being movable toward and away from the print head and being movable in a vertical direction; at least one contact portion provided on the body portion and operative to sealingly communicate with the at least one of the nozzles in accordance with the movement of the body portion; a pump in communication with the body portion for applying a negative pressure in the at least one of the nozzles through the body portion and the at least one contact portion in a suction purging of the at least one of the nozzles; first moving means for moving the body portion to bring the at least one contact portion into contact with the at least one of the nozzles for the suction purging and to separate the at least one contact portion from the at least one of the nozzles in a non-suction purging mode; and second moving means for vertically moving the body portion thereby vertically moving the at least one contact portion to align the at least one contact portion with the at least one of the nozzles of the nozzle array, the method comprising the steps of:

closing the ink discharge port;

contacting the at least one contact portion with the at least one of the nozzles;

energizing the pump for suction purging of the at least one of the nozzles;

deenergizing the pump for stopping the suction-purging of the at least one of the nozzles;

separating the at least one contact portion from the at least one of the nozzles after a predetermined period is elapsed from the deenergization;

opening the ink discharge port for discharging an ink from the body portion, the ink having been sucked in the body portion during the suction purging; and continuously moving the print head in a horizontal direction for successively performing the suction purging with respect to each nozzle of the nozzle array.

19. A method for suction-purging nozzles of an ink jet printer, using a suction purging unit for purging at least one nozzle of a nozzle array of a print head of the ink jet printer, the suction purging unit comprising a body portion for temporarily accumulating an ink sucked from the at least one of the nozzles and discharging the sucked ink through an ink discharge port, the body portion being movable toward and away from the print head and being movable in a vertical direction; at least one contact portion provided on the body portion and operative to sealingly communicate with the at least one of the nozzles in accordance with the movement of the body portion; a pump in communication with the body portion for applying a negative pressure in the at least one of the nozzles through the body portion and the at least one contact portion in a suction purging of the at least one of the nozzles; first moving means for moving the body portion to bring the at least one contact portion into contact with the at least one of the nozzles for the suction purging and to separate the at least one contact portion from the at least one of the nozzles in a non-suction purging mode; and second moving means for vertically moving the body portion thereby vertically moving the at least one contact portion to align the at least one contact portion with the at least one of the nozzles of the nozzle array, the method comprising the steps of:

closing the ink discharge port;

contacting the at least one contact portion with the at least one of the nozzles;

energizing the pump for suction purging of the at least one of the nozzles;

deenergizing the pump for stopping the suction-purging of the at least one of the nozzles;

separating the at least one contact portion from the at least one of the nozzles after a predetermined period is elapsed from the deenergization;

opening the ink discharge port for discharging an ink from the body portion, the ink having been sucked in the body portion during the suction purging; and intermittently moving the print head in a horizontal direction for successively performing the suction purging with respect to each nozzle of the nozzle array.

20. The suction purging method as claimed in claim 17, further comprising the step of selecting a specific one of the nozzle to be array suction-purged.

* * * * *